US007354260B1

(12) United States Patent
Chang

(10) Patent No.: US 7,354,260 B1
(45) Date of Patent: Apr. 8, 2008

(54) PNEUMATIC MOTOR INCLUDING A ROTOR IN A CYLINDER BETWEEN TWO COVERS IN A SHELL FROM WHICH AIR TRAVELS INTO THE CYLINDER THROUGH THE COVERS

(76) Inventor: Hsin-Ho Chang, 1F., No. 737, Dongping Rd., Taiping City, Taichung County 411 (TW)

( * ) Notice: Subject to any disclaimer, the term of this patent is extended or adjusted under 35 U.S.C. 154(b) by 0 days.

(21) Appl. No.: 11/623,754

(22) Filed: Jan. 17, 2007

(51) Int. Cl.
*F01C 21/00* (2006.01)
*F03C 4/00* (2006.01)
*F04C 29/00* (2006.01)

(52) U.S. Cl. ..... 418/270; 418/79; 418/81; 418/267; 418/268; 173/200; 173/218

(58) Field of Classification Search ..... 418/15, 418/75–77, 79, 81, 132, 259, 266–268; 173/200, 173/218
See application file for complete search history.

(56) References Cited

U.S. PATENT DOCUMENTS 3,238,848 A * 3/1966 Bent ..... 418/268
3,865,520 A * 2/1975 Kramer et al. ..... 418/82
3,901,631 A * 8/1975 Wickham et al. ..... 418/270
3,927,956 A * 12/1975 Linthicum ..... 418/270
5,087,180 A * 2/1992 Clapp ..... 418/133

* cited by examiner

*Primary Examiner*—Theresa Trieu
(74) *Attorney, Agent, or Firm*—Banger Shia

(57) ABSTRACT

A pneumatic motor includes a shell, two covers, a cylinder and a rotor. The shell defines a space, at least one inlet in communication with the space and at least one outlet in communication with the space. Each of the covers defines at least one radial channel and at least one arched channel in communication with the radial channel. The covers are disposed in the central space of the shell while the radial channel is in communication with the inlet. The cylinder defines a central space and at least one inlet in communication with the central space. The cylinder is located between the covers so that the central space thereof is in communication with the arched channels of the covers and that the inlet thereof is communication with the inlet of the shell. The rotor includes a plurality of fins movably mounted thereon.

4 Claims, 16 Drawing Sheets

PNEUMATIC MOTOR INCLUDING A ROTOR IN A CYLINDER BETWEEN TWO COVERS IN A SHELL FROM WHICH AIR TRAVELS INTO THE CYLINDER THROUGH THE COVERS

BACKGROUND OF INVENTION

1. Field of Invention

The present invention relates to a pneumatic motor and, more particularly, to a pneumatic motor that is small in size, easy in fabrication and low in cost.

2. Related Prior Art

Referring to FIGS. 1 through 8, a conventional pneumatic motor includes a shell 10, two covers 20 located in the shell 10, a cylinder 30 located between the covers 20 and a rotor 40 located on the covers 20.

Referring to FIG. 8, the shell 10 defines a space 15 for containing the other elements, two inlets 17 defined in the wall of the space 15 and an outlet 16 defined in an internal side of the wall of the space 15.

Referring to FIGS. 2 and 3, each of the covers 20 defines a central aperture 21, two arched channels 23 in an internal side, two recesses 24 in the internal side and two radial channels 22 for communicating each of the arched channels 23 with a related one of the recesses 24.

Referring to FIGS. 4 and 5, the cylinder 30 defines an eccentric space 31 for receiving the rotor 40. The wall of the eccentric space 31 (or the cylinder 30) includes a thick portion and a thin portion opposite to the thick portion. Two inlets 32 are defined in the thick portion of the cylinder 30. Two apertures 33 are defined in an end of the thick portion of the cylinder 30. Two cavities 34 are defined in an external side of the thick portion of the cylinder 30. Each of the cavities 34 communicates a related one of the inlets 32 with a related one of the apertures 33. A plurality of outlets 35 is defined in the thin portion of the cylinder 30.

The rotor 40 includes two shafts 41 each extending from an end and a plurality of grooves 42 longitudinally defined in the periphery. A fin 45 is movably disposed in each of the grooves 42.

Referring to FIG. 6, the rotor 40 is disposed in the eccentric space 31 of the cylinder 30. Each of the shafts 41 is inserted in the aperture 21 of a related one of the covers 20. The covers 20 are attached to the cylinder 30. The cylinder 30 is disposed in the shell 10.

Referring to FIGS. 7 and 8, pressurized air travels into the cavities 34 from the inlets 17. A first portion of the pressurized air travels into the space 31 through the inlets 32 while a second portion of the pressurized air travels into the recesses 24 through the apertures 33. From the recesses 24, the second portion of the pressurized air travels into the arched channels 23 through the radial channels 22. Finally, the second portion of the pressurized air travels into the space 31 from the arched channels 23.

Some problems have been encountered in the fabrication and use of this conventional pneumatic motor. Firstly, the manufacturing is troublesome and expensive. This is partly because a lot of apertures, channels, recesses and cavities are made. This is partly because high precision is required in casting the cylinder 30 while eccentrically making the eccentric space 31 in the cylinder 30. Secondly, the cylinder 30 is bulky and heavy for including the thick portion.

The present invention is therefore intended to obviate or at least alleviate the problems encountered in prior art.

SUMMARY OF INVENTION

It is an objective of the present invention to provide an inexpensive pneumatic motor.

It is another objective of the present invention to provide a small and light pneumatic motor.

According to the present invention, a pneumatic motor includes a shell, two covers, a cylinder and a rotor. The shell defines a space, at least one inlet in communication with the space and at least one outlet in communication with the space. Each of the covers defines at least one radial channel and at least one arched channel in communication with the radial channel. The covers are disposed in the central space of the shell while the radial channel is in communication with the inlet. The cylinder defines a central space and at least one inlet in communication with the central space. The cylinder is located between the covers so that the central space thereof is in communication with the arched channels of the covers and that the inlet thereof is communication with the inlet of the shell. The rotor includes a plurality of fins movably mounted thereon.

Other objectives, advantages and features of the present invention will become apparent from the following description referring to the attached drawings.

BRIEF DESCRIPTION OF DRAWINGS

The present invention will be described through detailed illustration of the preferred embodiment in view of prior art referring to the drawings.

DETAILED DESCRIPTION OF PREFERRED EMBODIMENT

Figure 1:
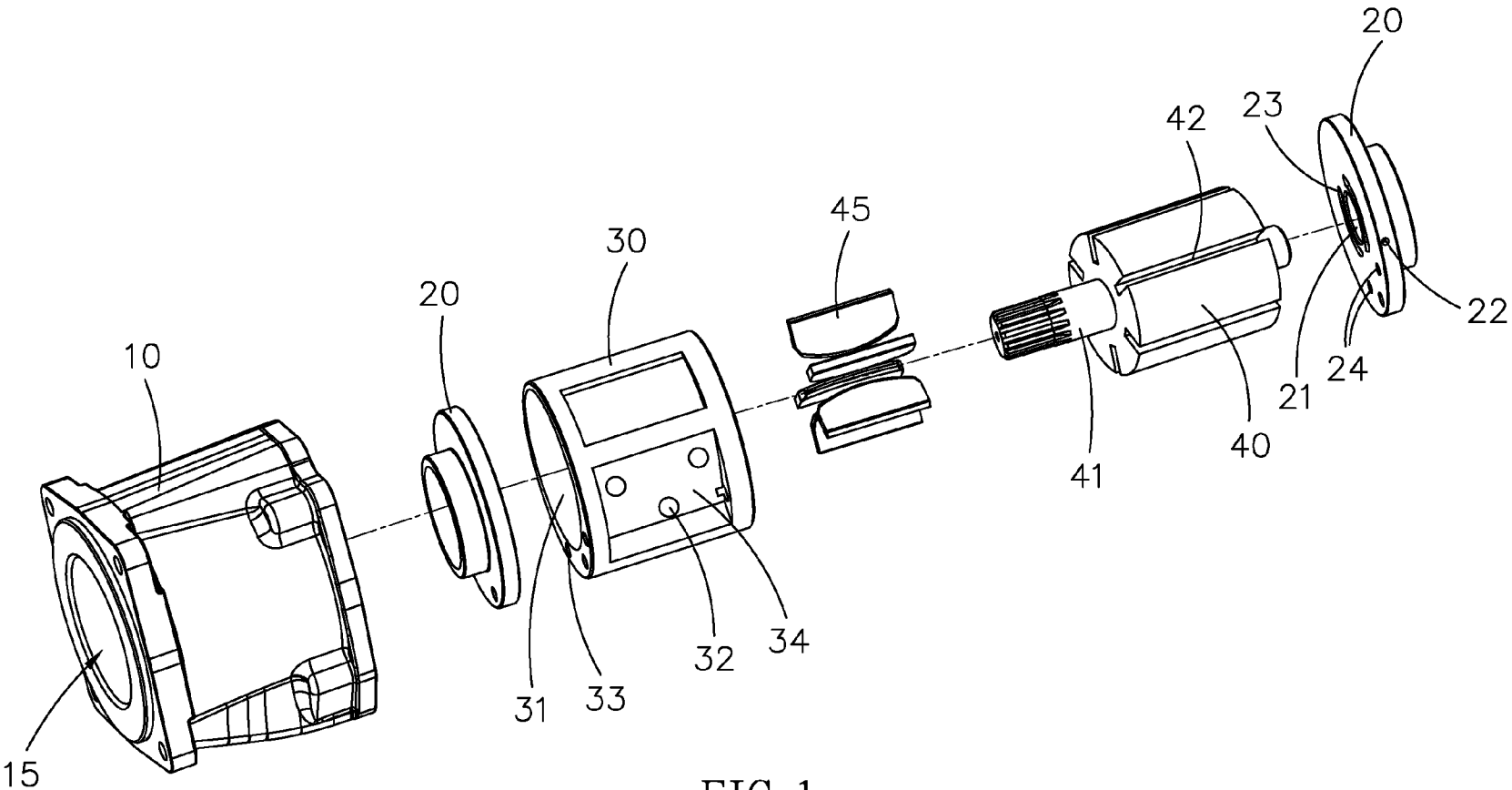
FIG. 1 PRIOR ART
FIG. 1 is an exploded view of a conventional pneumatic motor.
Figure 2:
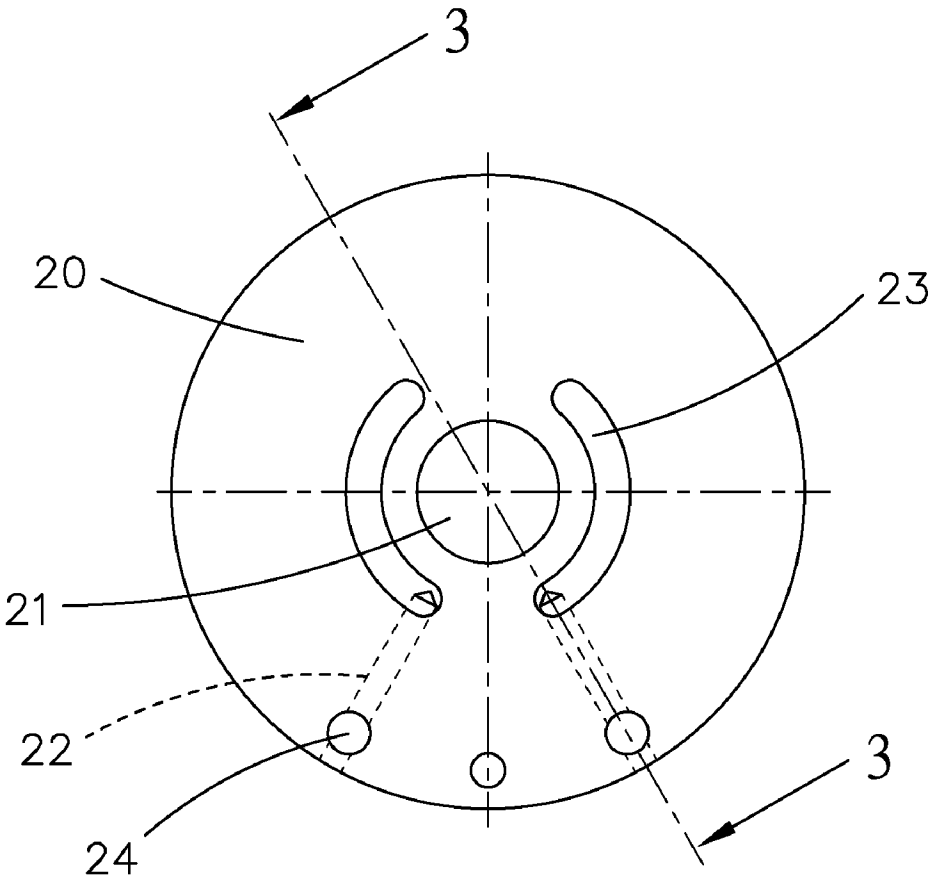
FIG. 2 PRIOR ART
FIG. 2 is a front view of a cover used in the conventional pneumatic motor shown in FIG. 1.
Figure 3:
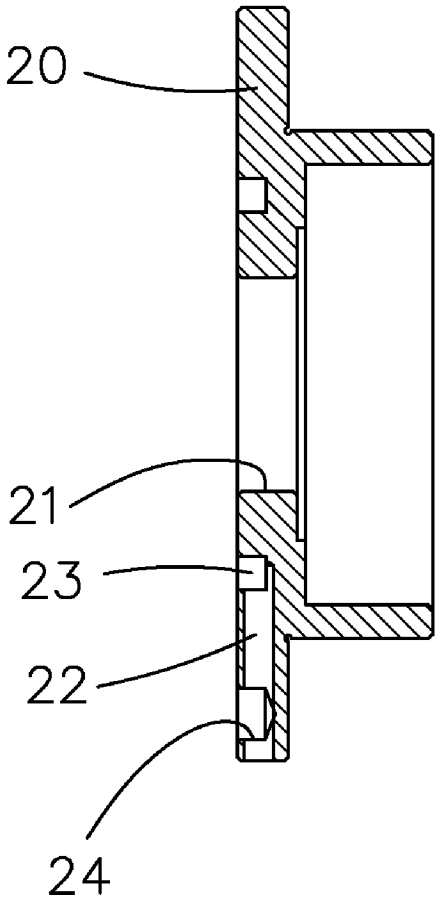
FIG.3 PRIOR ART
FIG. 3 is a cross-sectional view of the cover taken along a line 3-3 shown in FIG. 2.
Figure 4:
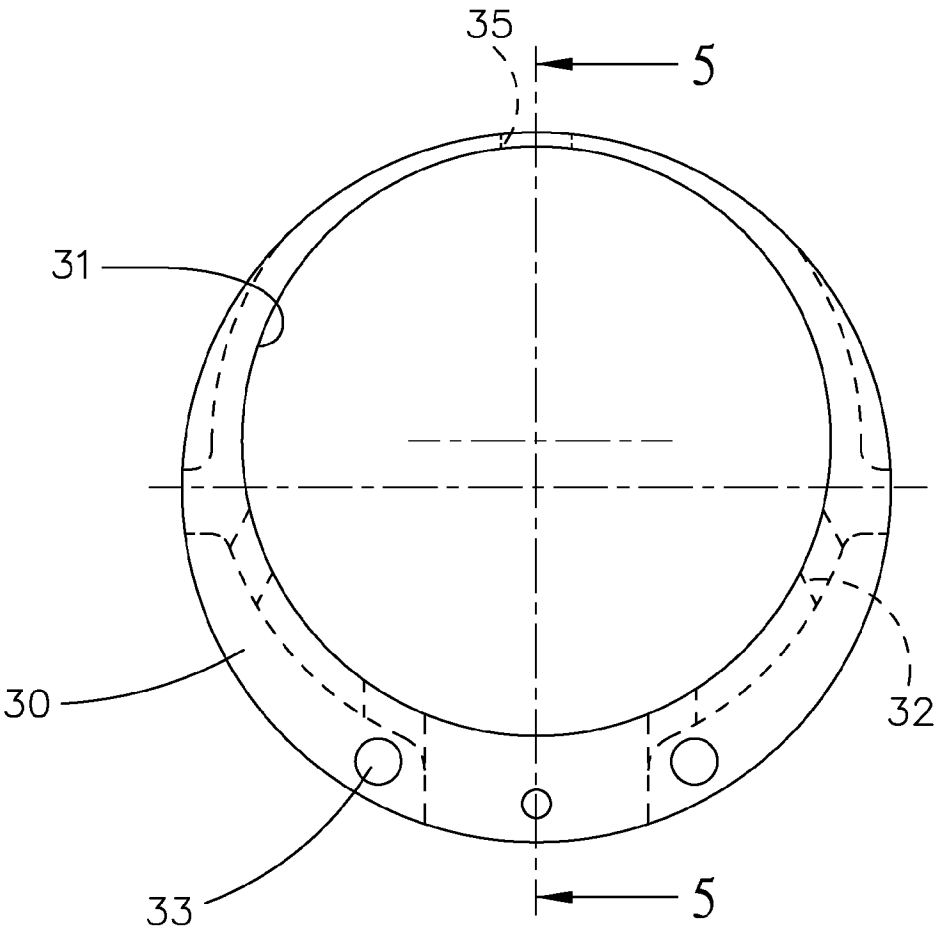
FIG.4 PRIOR ART
FIG. 4 is a front view of a cylinder of the conventional pneumatic motor shown in FIG. 1.
Figure 5:
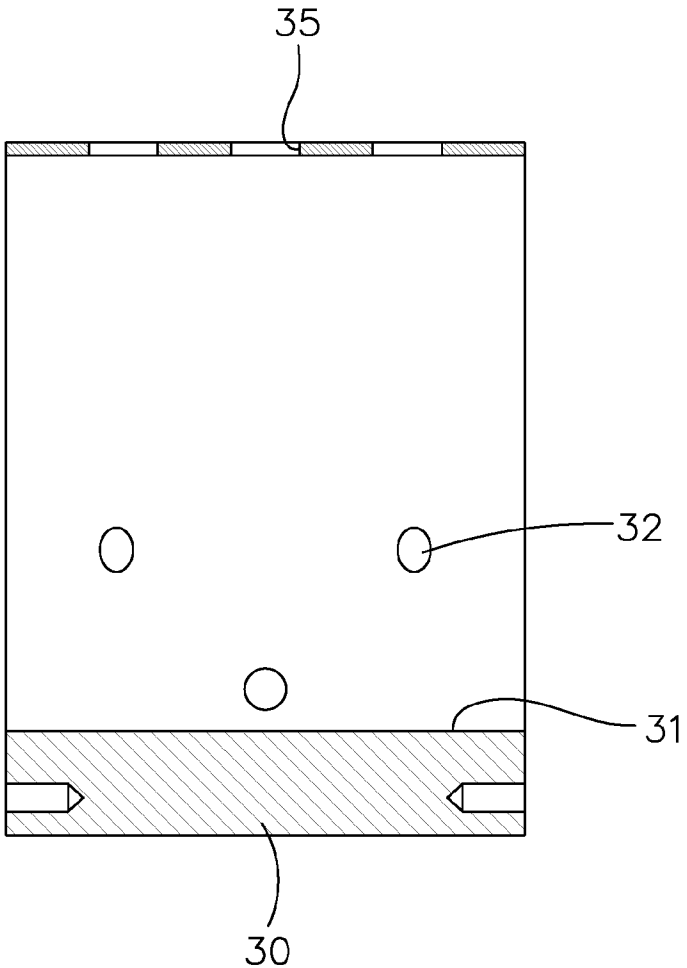
FIG. 5 PRIOR ART
FIG. 5 is a cross-sectional view of the cylinder taken along a line 5-5 shown in FIG. 4.
Figure 6:
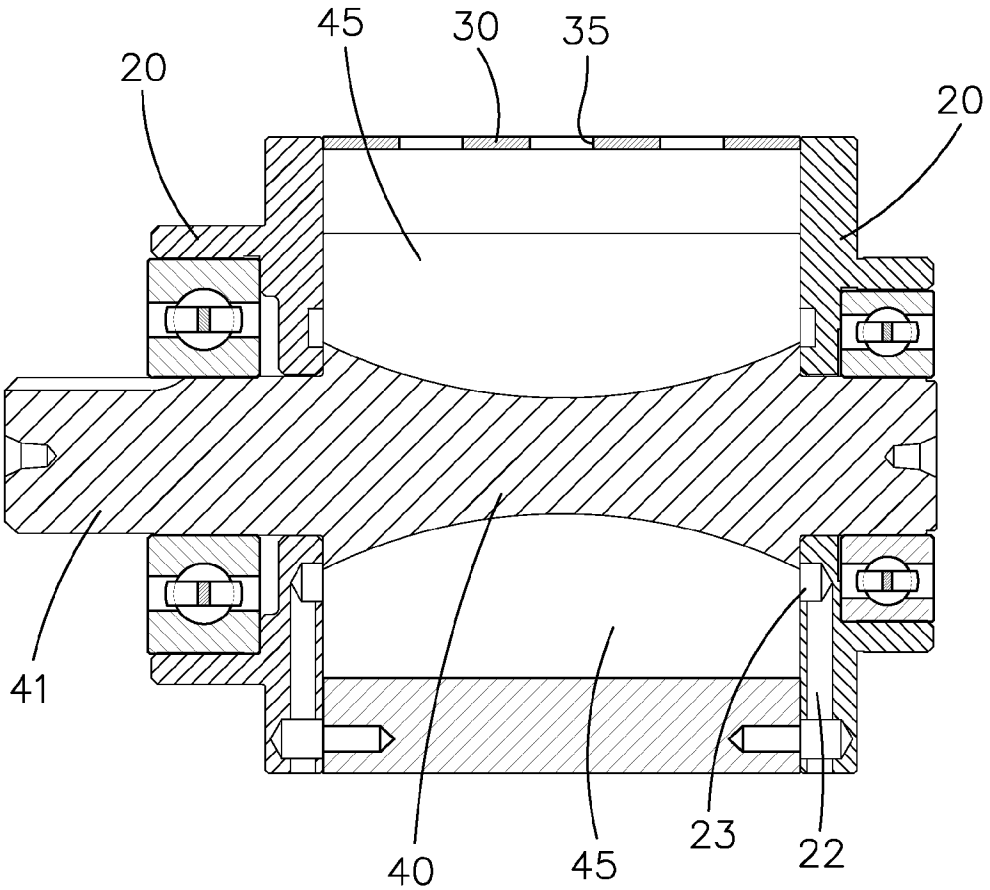
FIG.6 PRIOR ART
FIG. 6 is a cross-sectional view of the conventional pneumatic motor shown in FIG. 1 except a shell.
Figure 7:
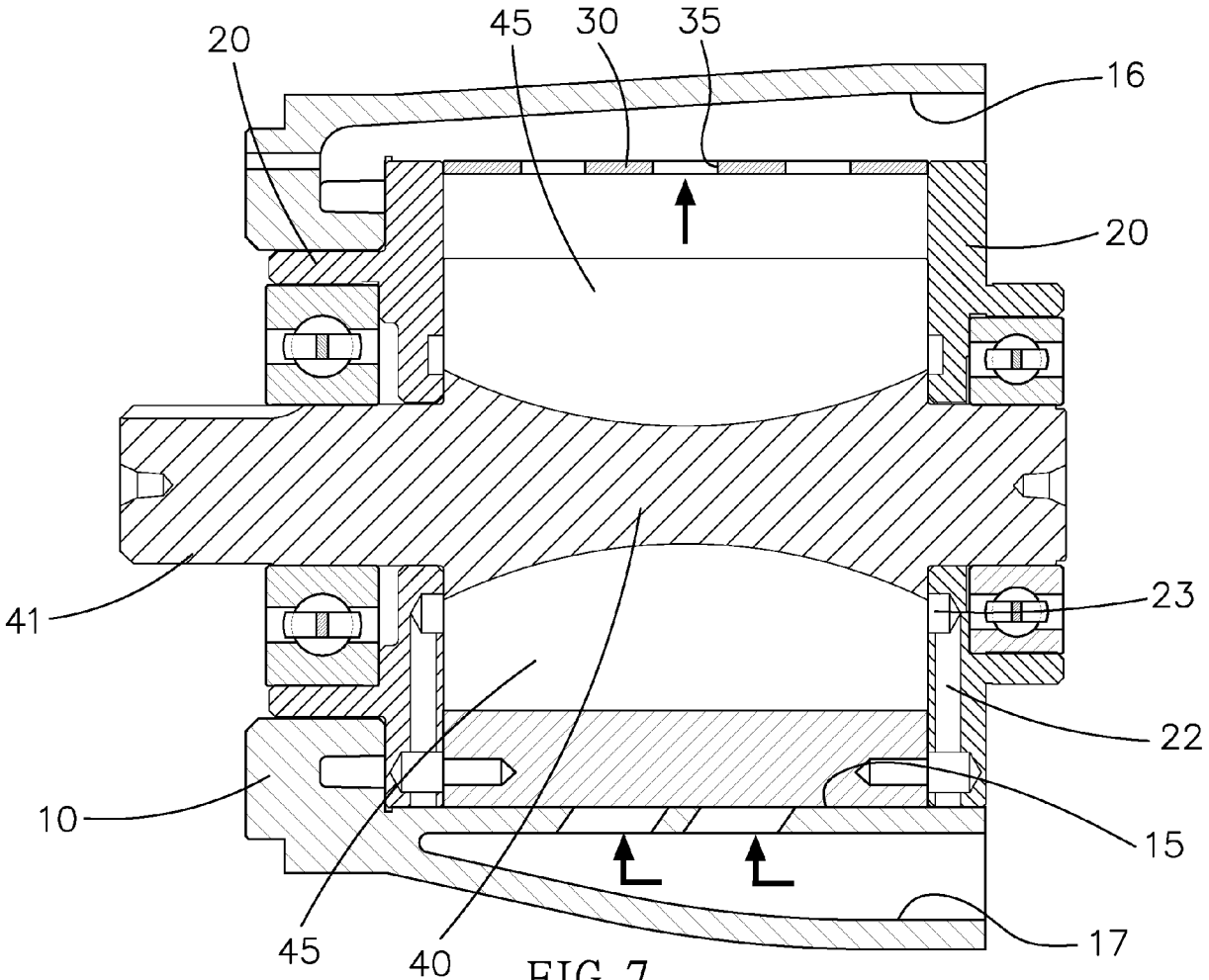
FIG.7 PRIOR ART
FIG. 7 is a cross-sectional view of the conventional pneumatic motor shown in FIG. 1.
Figure 8:
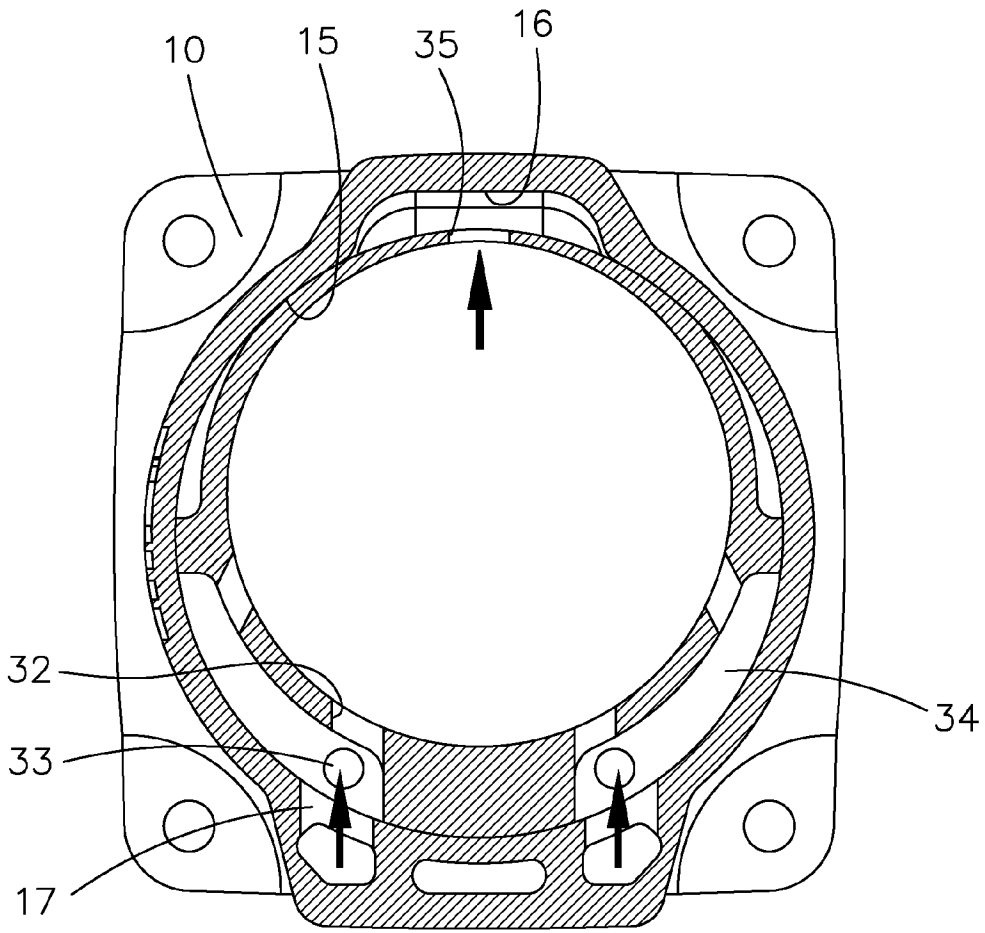
FIG. 8 PRIOR ART
FIG. 8 is a cross-sectional view of the conventional pneumatic motor shown in FIG. 7.
Figure 9:
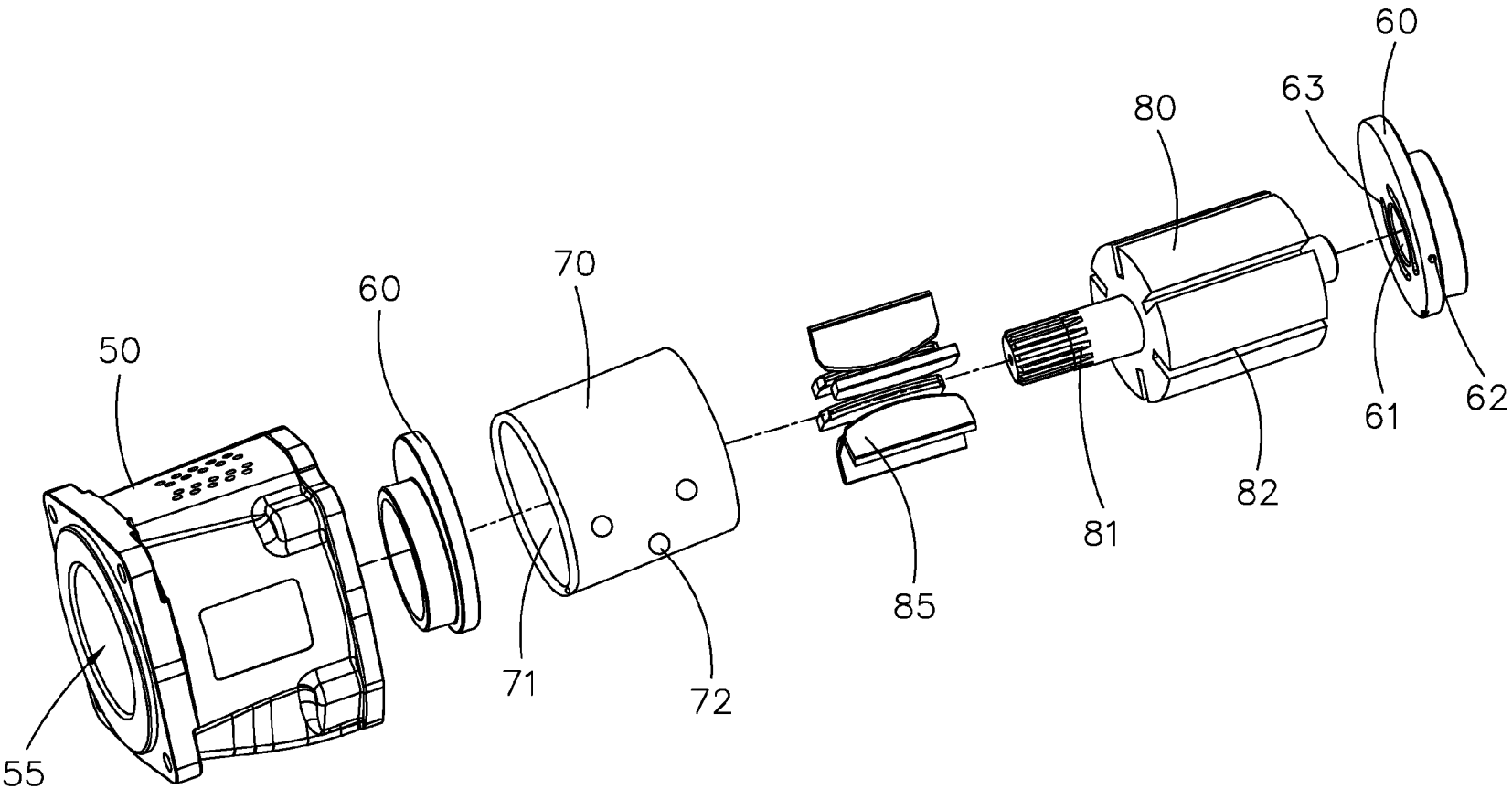
FIG. 9 is an exploded view of a pneumatic motor according to the preferred embodiment of the present invention.

Referring to FIGS. 9 through 16, a pneumatic motor according to the preferred embodiment of the present invention includes a shell 50, two covers 60 located in the shell 50, a cylinder 70 located between the covers 60 and a rotor 80 located on the covers 60.

Figure 16:
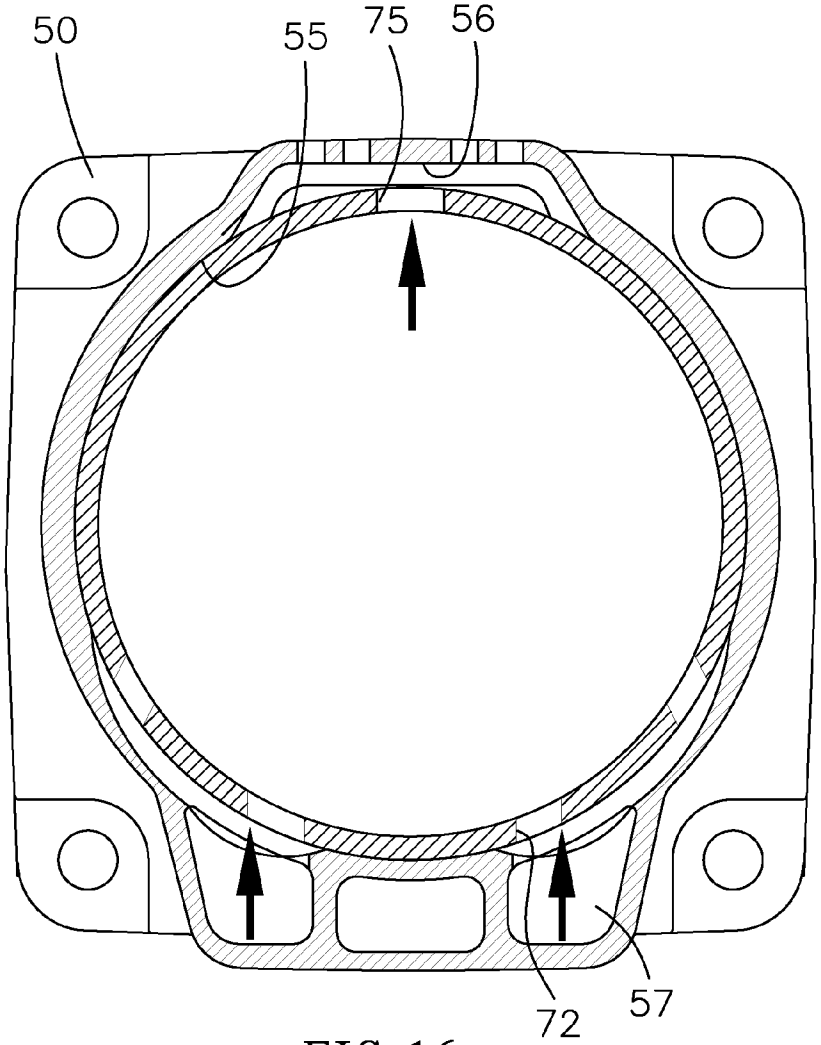
FIG. 16 is a cross-sectional view of the pneumatic motor of FIG. 15.

Referring to FIG. 16, the shell 50 defines a space 55 for containing the other elements, two inlets 57 defined in the thickness of the wall of the space 55 and an outlet 56 defined in an internal side of the wall of the space 55.

Figure 10:
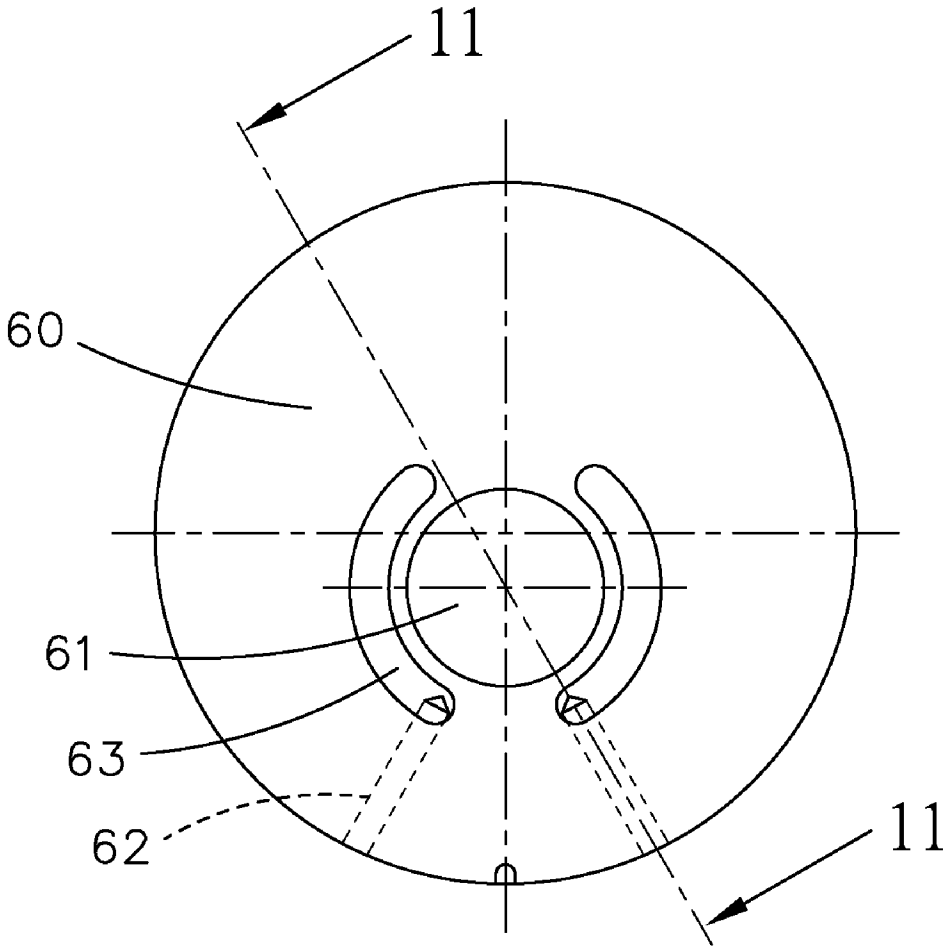
FIG. 10 is a front view of a cover used in the pneumatic motor shown in FIG. 9.
Figure 11:
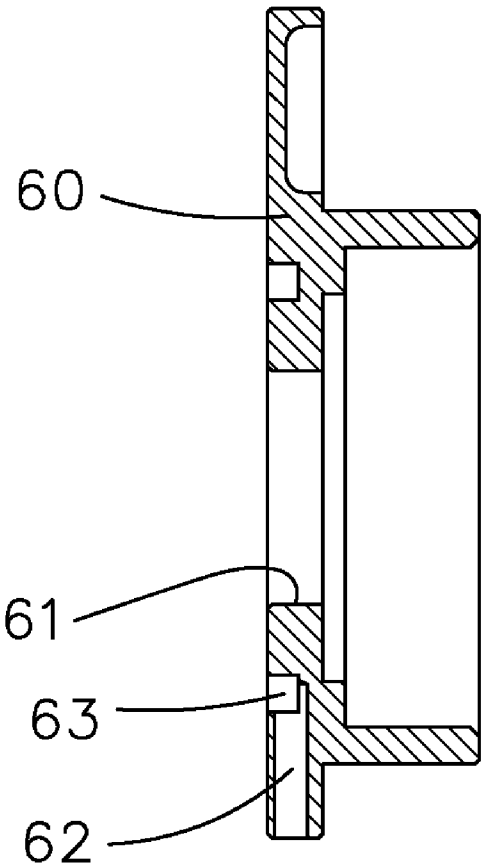
FIG. 11 is a cross-sectional view of the cover taken along a line 11-11 shown in FIG. 10.

Referring to FIGS. 10 and 11, each of the covers 60 eccentrically defines an aperture 61. Each of the covers 60 includes two arched channels 63 defined in an internal side and two radial channels 62 defined in the thickness. Each of the radial channels 62 is in communication with a related one of the arched channels 63.

Figure 12:
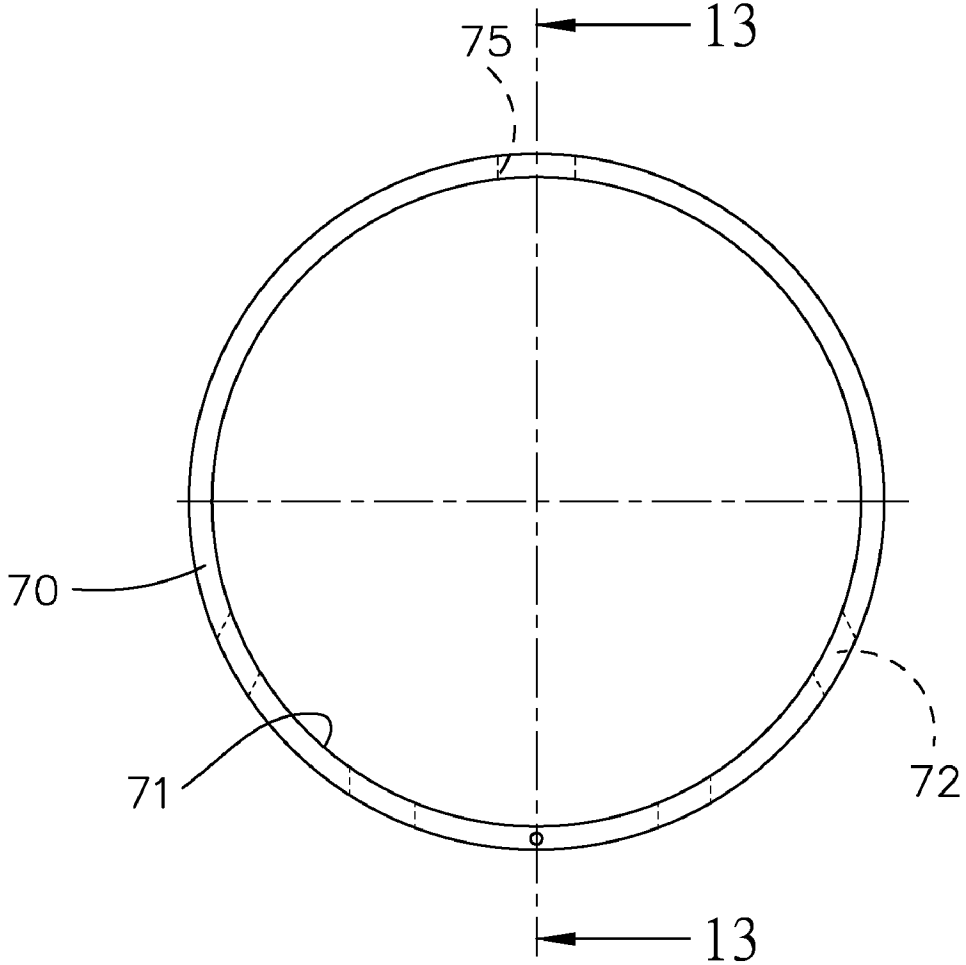
FIG. 12 is a front view of a cylinder of the pneumatic motor shown in FIG. 9.
Figure 13:
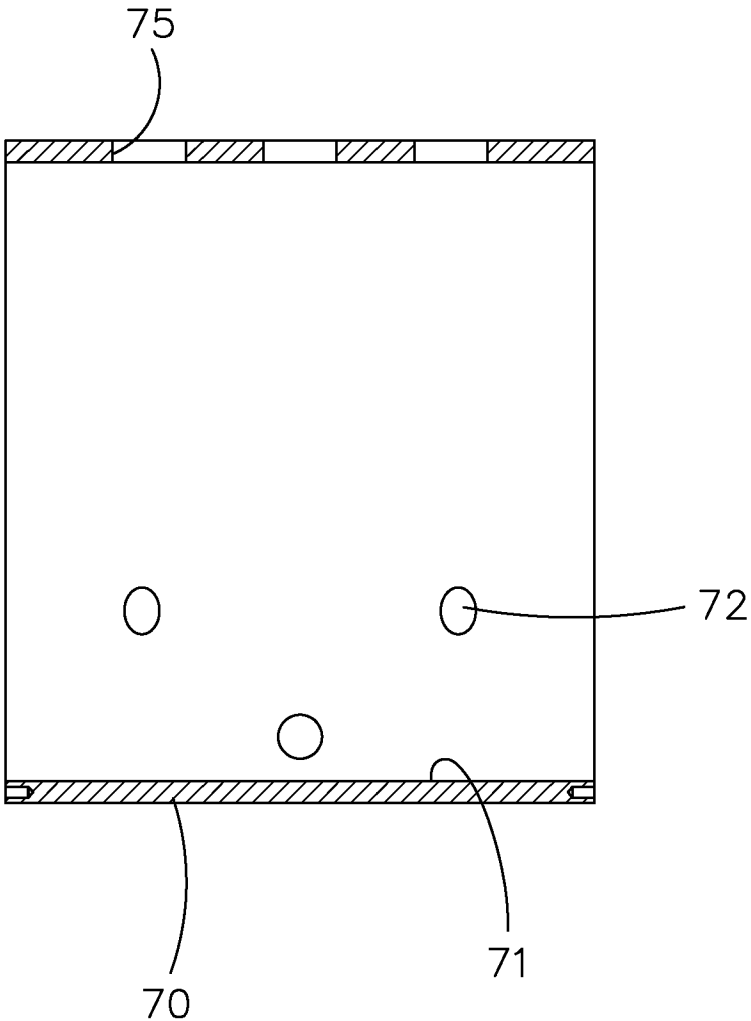
FIG. 13 is a cross-sectional view of the cylinder taken along a line 13-13 shown in FIG. 12.

Referring to FIGS. 12 and 13, the cylinder 70 defines an axial space 71 for receiving the rotor 80, two inlets 72 in communication with the axial space 71 and a series of outlets 75 in communication with the axial space 71.

The rotor 80 includes two shafts 81 each extending from an end and a plurality of grooves 82 longitudinally defined in the periphery. A fin 85 is movably disposed in each of the grooves 82.

Figure 14:
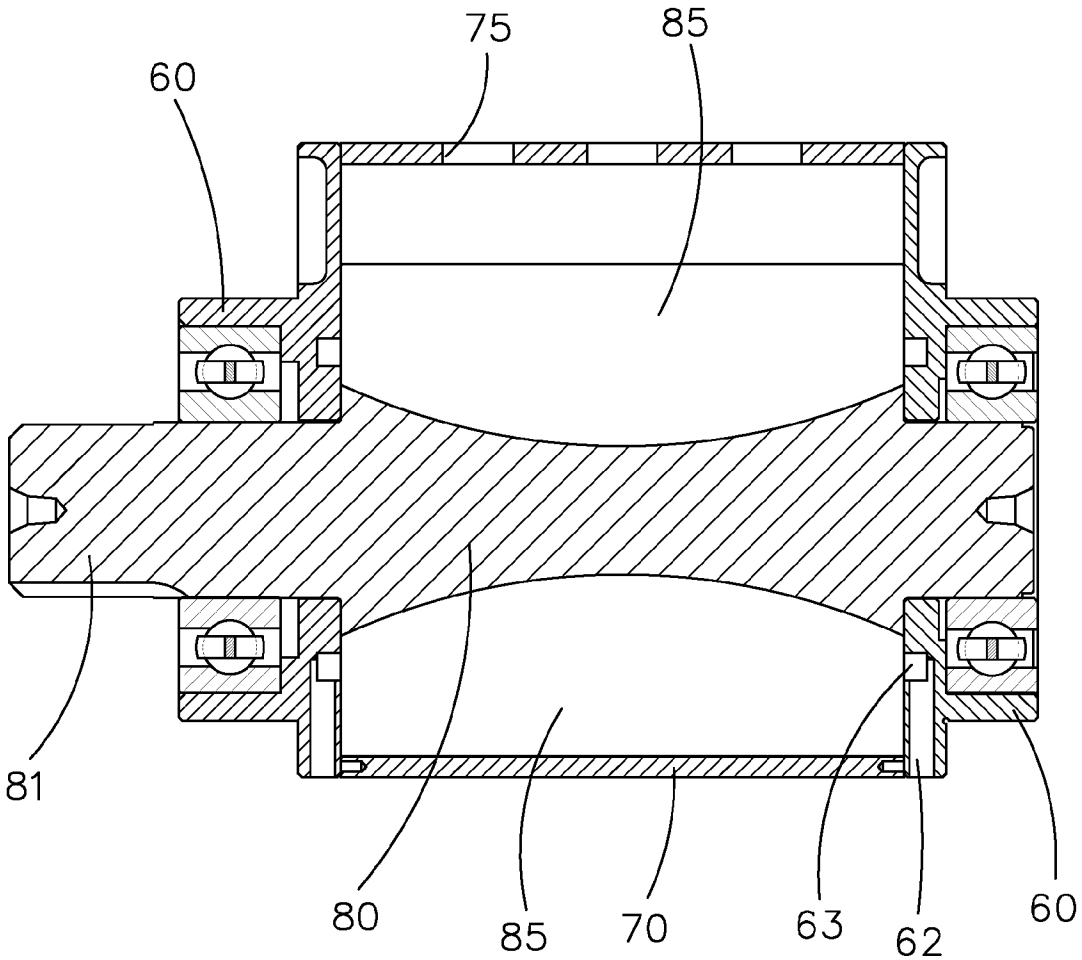
FIG. 14 is a cross-sectional view of the pneumatic motor of FIG. 9 except a shell.

Referring to FIG. 14, the rotor 80 is disposed in the space 71 of the cylinder 70. Each of the shafts 81 is inserted in the eccentric aperture 61 of a related one of the covers 60. The covers 60 are attached to the cylinder 70. The cylinder 70 is disposed in the shell 50.

Figure 15:
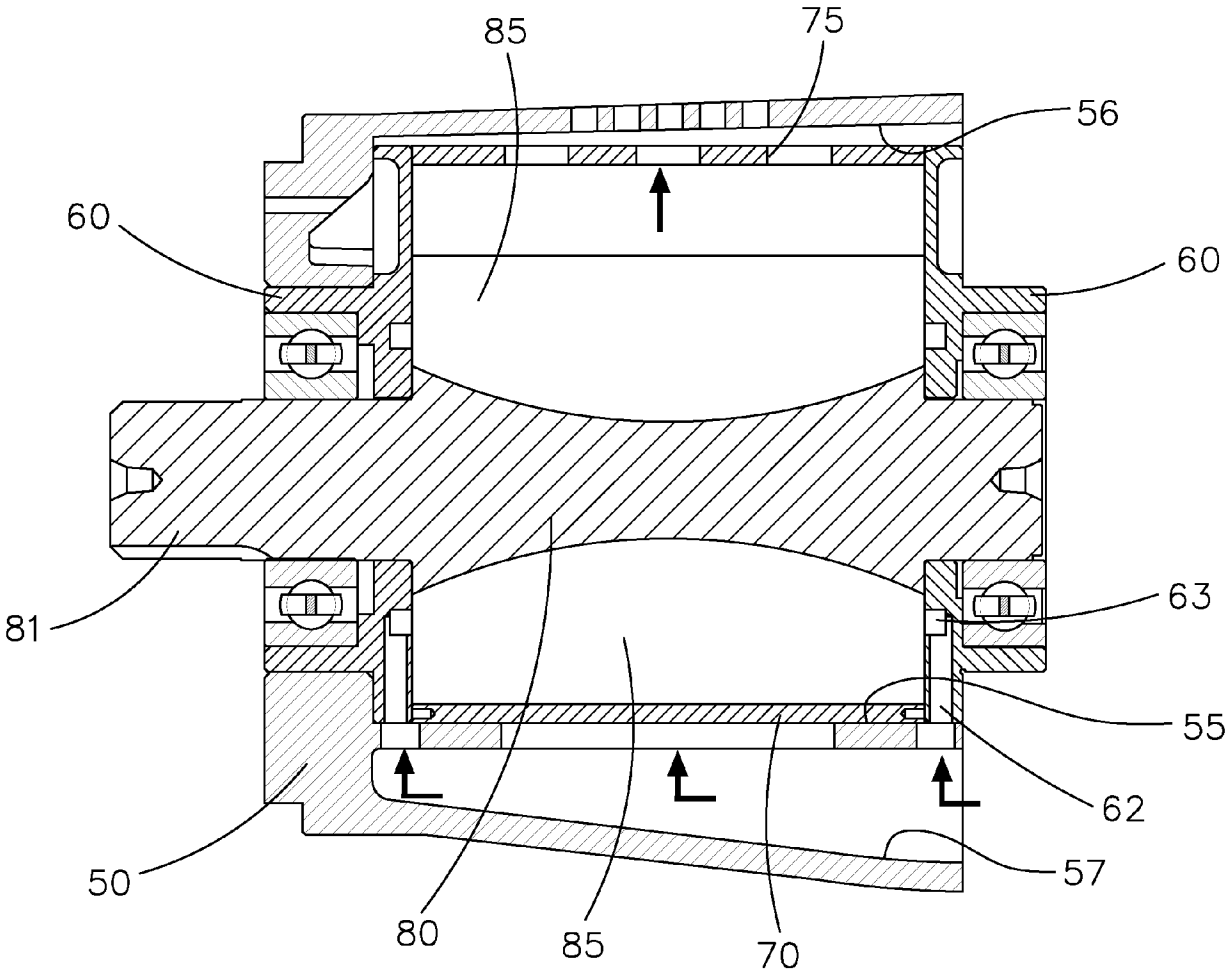
FIG. 15 is a cross-sectional view of the pneumatic motor of FIG. 9.

Referring to FIGS. 15 and 16, pressurized air goes into the inlets 57. A first portion of the pressurized air goes into the space 71 through the inlets 72 while a second portion of the pressurized air goes into the radial channels 62. Finally, the second portion of the pressurized air goes into the space 71 through the arched channels 63.

The pneumatic motor of the present invention exhibits advantages over the conventional pneumatic motor described in Related Prior Art. Firstly, the fabrication is easy and inexpensive. This is partly because a small number of apertures, channels, recesses and cavities are made. This is partly because the cylinder 70 is not made by casting that requires high precision. Secondly, the cylinder 70 is small and light for omitting the thick portion.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A pneumatic motor comprising:

a shell defining a space, at least one inlet in communication with the space and at least one outlet in communication with the space;

two covers each defining at least one radial channel in the thickness thereof and at least one arched channel in a side in communication with the radial channel, wherein the covers are disposed in the space of the shell while the radial channels are directly in communication with the inlet of the shell;

a cylinder defining a central space and at least one inlet in communication with the central space, wherein the cylinder is located between the covers and in the shell so that the central space thereof is in communication with the arched channels of the covers and that the inlet thereof is communication with the inlet of the shell; and a rotor comprising a plurality of fins movably mounted thereon.

2. The pneumatic motor according to claim 1 wherein the radial channel is defined in the thickness of each of the covers.

3. The pneumatic motor according to claim 1 wherein the arched channel is defined in a side of each of the covers.

4. The pneumatic motor according to claim 1 wherein the shell defines two inlets, each of the covers defines two radial channels and two arched channels, and the cylinder defines two groups of inlets so that each of the groups is in communication with a related one of the inlets of the shell.

* * * * *